US010436401B2

(12) United States Patent
Lee

(10) Patent No.: US 10,436,401 B2
(45) Date of Patent: Oct. 8, 2019

(54) ELECTRONIC CANDLE LAMP AND LIGHT-EMITTING DIODE (LED) LAMP

(71) Applicant: ATAKE DIGITAL TECHNOLOGY (SHENZHEN) CO., LTD., Shenzhen, Guangdong Province (CN)

(72) Inventor: Kuo-Tsai Lee, Shenzhen (CN)

(73) Assignee: ATAKE DIGITAL TECHNOLOGY (SHENZHEN) CO., LTD., Shenzhen, Guangdong Province (CN)

( * ) Notice: Subject to any disclaimer, the term of this patent is extended or adjusted under 35 U.S.C. 154(b) by 155 days.

(21) Appl. No.: 14/684,329

(22) Filed: Apr. 10, 2015

(65) Prior Publication Data

US 2018/0163937 A1 Jun. 14, 2018

(30) Foreign Application Priority Data

Jan. 8, 2015 (CN) ..... 2015 1 0009697

(51) Int. Cl.

| | |
|---|---|
| ***F21S 10/04*** | (2006.01) |
| ***H05B 33/08*** | (2006.01) |
| ***H05B 37/02*** | (2006.01) |
| ***G09F 9/33*** | (2006.01) |
| ***G09G 3/32*** | (2016.01) |

(Continued)

(52) U.S. Cl.

CPC ..... *F21S 10/043* (2013.01); *G09F 9/33* (2013.01); *G09G 3/2085* (2013.01); *G09G 3/32* (2013.01); *H05B 33/0842* (2013.01); *H05B 33/0845* (2013.01); *H05B 37/029* (2013.01); *F21V 1/00* (2013.01); *F21W 2121/00* (2013.01);

(Continued)

(58) Field of Classification Search

None

See application file for complete search history.

(56) References Cited

U.S. PATENT DOCUMENTS 5,996,660 A * 12/1999 Kakumu ..... B60C 11/0318 152/209.1
8,157,425 B2 * 4/2012 Gutstein ..... F21S 6/001 362/392

(Continued)

FOREIGN PATENT DOCUMENTS

CN 2397360 Y 9/2000
CN 101603661 A 12/2009

(Continued)

*Primary Examiner* — Crystal L Hammond
(74) *Attorney, Agent, or Firm* — Cheng-Ju Chiang

(57) ABSTRACT

The present disclosure discloses a light-emitting diode (LED) lamp and an electronic candle lamp, which comprise a baseplate, a plurality of groups of lamp bodies, a lamp shade and a controlling device. The plurality of groups of lamp bodies are disposed on the baseplate, and each group of the lamp bodies respectively comprises a plurality of LEDs arranged in a matrix form; the lamp shade is disposed on the baseplate and has the plurality of groups of lamp bodies nested therein; and the controlling device is electrically connected to the plurality of groups of lamp bodies to control part of the LEDs in each group of the lamp bodies to emit light so that the electronic candle lamp presents a candlelight effect with flickering flames. The LED lamp and the electronic candle lamp of the present disclosure are electronically controlled to realistically simulate the candlelight effect with flickering flames.

6 Claims, 18 Drawing Sheets

(51) Int. Cl.

| | |
|---|---|
| ***G09G 3/20*** | (2006.01) |
| *F21Y 105/16* | (2016.01) |
| *F21Y 115/10* | (2016.01) |
| *F21V 1/00* | (2006.01) |
| *F21W 121/00* | (2006.01) |
| *F21Y 107/00* | (2016.01) |

(52) U.S. Cl.
CPC ..... *F21Y 2105/16* (2016.08); *F21Y 2107/00* (2016.08); *F21Y 2115/10* (2016.08)

(56) References Cited

U.S. PATENT DOCUMENTS

| | | | | |
|---|---|---|---|---|
| 8,721,121 | B1 * | 5/2014 | Briles | F21S 10/06 362/249.14 |
| 9,303,824 | B2 * | 4/2016 | Sun | F21V 29/83 |
| 9,360,181 | B2 * | 6/2016 | Li | F21V 33/0088 |
| 2003/0072154 | A1 * | 4/2003 | Moore | F21S 10/04 362/234 |
| 2005/0275626 | A1 * | 12/2005 | Mueller | H05B 37/0245 345/156 |
| 2006/0083017 | A1 * | 4/2006 | Wang | B64F 1/20 362/547 |
| 2011/0019422 | A1 * | 1/2011 | Schnuckle | F21S 10/04 362/277 |
| 2011/0133649 | A1 * | 6/2011 | Kreiner | H05B 33/0842 315/86 |
| 2011/0163683 | A1 * | 7/2011 | Steele | F21V 23/02 315/192 |
| 2012/0040585 | A1 * | 2/2012 | Huang | F21K 9/90 445/43 |
| 2013/0265746 | A1 * | 10/2013 | May | F21S 8/04 362/147 |
| 2015/0369432 | A1 * | 12/2015 | Li | F21S 6/001 362/249.02 |

FOREIGN PATENT DOCUMENTS

| | | | |
|---|---|---|---|
| CN | 201359252 | Y | 12/2009 |
| CN | 102135244 | A | 7/2011 |
| CN | 202691654 | U | 1/2013 |
| CN | 202992822 | U | 6/2013 |
| CN | 204554682 | U | 8/2015 |

* cited by examiner

ELECTRONIC CANDLE LAMP AND LIGHT-EMITTING DIODE (LED) LAMP

CROSS REFERENCE TO RELATED APPLICATIONS

This application claims the benefit of China Application No. 201510009697.3, which was filed on Jan. 8, 2015, and is included herein by reference.

FIELD OF THE INVENTION

The present disclosure generally relates to the technical field of lighting, and more particularly, to an electronic candle lamp and a light-emitting diode (LED) lamp.

BACKGROUND OF THE INVENTION

As a kind of novel solid-state light source, light-emitting diodes (LEDs) feature low power consumption, a small volume, a fast respond speed, a long service life, and simple dimming and color modulating operations, and are energy saving and environment friendly. Moreover, they are much better than traditional light sources such as incandescent lamps or fluorescent lamps in terms of production, manufacturing, and usability.

Currently, LEDs have become very popular and are widely used in various lamps (e.g., candlelight lamps). However, light distribution of existing LED candlelight lamps is not particularly designed and the light rays emitted by each portion of the whole lamp are disordered. That is, the whole lamp is only shaped as a candle and can not present a real candlelight effect.

SUMMARY OF THE INVENTION

The primary technical problem to be solved by the present disclosure is to provide a light-emitting diode (LED) lamp and an electronic candle lamp, which are electronically controlled to present a candlelight effect with flickering flames.

To solve the aforesaid technical problem, one technical solution adopted by the present disclosure is to provide a light-emitting diode (LED) lamp, which comprises a baseplate, a plurality of groups of lamp bodies, a lamp shade and a controlling device. The plurality of groups of lamp bodies are disposed on the baseplate, and each group of the lamp bodies respectively comprises a plurality of light-emitting diodes (LEDs) arranged in a matrix; the lamp shade is disposed on the baseplate and has the plurality of groups of lamp bodies nested therein; and the controlling device is electrically connected to the plurality of groups of lamp bodies and is configured to control part of the LEDs in each group of the lamp bodies to emit light so that the electronic candle lamp presents a candlelight effect with flickering flames.

Preferably, the plurality of groups of lamp bodies are arranged about a same center, every two adjacent lamp bodies form a predetermined angle therebetween, and each group of the lamp bodies respectively comprises a circuit board, a first LED matrix and a second LED matrix. The circuit board is disposed vertically on the baseplate; the first LED matrix is disposed on a first surface of the circuit board; and the second LED matrix is disposed on a second surface of the circuit board, and the first surface is opposite to the second surface.

Preferably, the electronic candle lamp comprises three groups of the lamp bodies, and every two adjacent lamp bodies form an angle of 120 degrees therebetween.

Preferably, a first surface of each group of the lamp bodies faces a second surface of an adjacent group of the lamp bodies, and the first LED matrix on the first surface of each group of the lamp bodies and the second LED matrix on the second surface of the adjacent group of the lamp bodies form a light-emitting surface.

Preferably, each of the first LED matrix and the second LED matrix on the same light-emitting surface is a 4×16 LED matrix, and the first LED matrix and the second LED matrix together form an 8×16 LED matrix.

Preferably, during the displaying of the electronic candle lamp, an image displayed by each of the light-emitting surfaces at least comprises some or all of the following pictures: a first frame of picture, in which the LEDs of rows 6 to 14 in column 3, the LEDs of rows 3 to 15 in columns 4, 5, and the LEDs of rows 5 to 13 in column 6 in the light-emitting surface are lightened; a second frame of picture, in which the LEDs of rows 7 to 13 in column 3, the LEDs of rows 1 to 15 in columns 4, 5, and the LEDs of rows 5 to 14 in column 6 in the light-emitting surface are lightened; a third frame of picture, in which the LEDs of rows 6 to 12 in column 3, the LEDs of rows 5 to 15 in column 4, the LEDs of rows 3 to 15 in column 5, the LEDs of rows 3 to 13 in column 6, and the LEDs of rows 6 to 11 in column 7 in the light-emitting surface are lightened; a fourth frame of picture, in which the LEDs of rows 6 to 16 in column 4, the LEDs of rows 4 to 16 in column 5, the LEDs of rows 4 to 14 in column 6, and the LEDs of rows 5 to 12 in column 7 in the light-emitting surface are lightened; a fifth frame of picture, in which the LEDs of rows 5 to 15 in column 3, the LEDs of rows 5 to 16 in column 4, the LEDs of rows 6 to 16 in column 5, and the LEDs of rows 9 to 14 in column 6 in the light-emitting surface are lightened; a sixth frame of picture, in which the LEDs of rows 13 to 16 in column 3, the LEDs of rows 12 to 16 in column 4, the LEDs of rows 11 to 16 in columns 5, 6, and the LEDs of rows 12 to 15 in column 7 in the light-emitting surface are lightened; a seventh frame of picture, in which the LEDs of rows 8 to 16 in columns 4, 5, the LEDs of rows 7 to 15 in column 6, the LEDs of rows 7 to 14 in column 7, and the LEDs of rows 7 to 11 in column 8 in the light-emitting surface are lightened; an eighth frame of picture, in which the LEDs of rows 10 to 16 in column 4, the LEDs of rows 8 to 16 in column 5, the LEDs of rows 7 to 16 in column 6, the LEDs of rows 6 to 14 in column 7, and the LEDs of rows 5 to 12 in column 8 in the light-emitting surface are lightened; a ninth frame of picture, in which the LEDs of rows 7 to 16 in column 4, the LEDs of rows 4 to 16 in column 5, the LEDs of rows 3 to 15 in column 6, and the LEDs of rows 3 to 14 in column 7 in the light-emitting surface are lightened; a tenth frame of picture, in which the LEDs of rows 10 to 15 in column 4, the LEDs of rows 7 to 15 in column 5, the LEDs of rows 6 to 14 in column 6, the LEDs of rows 3 to 13 in column 7, and the LEDs of rows 3 to 10 in column 8 in the light-emitting surface are lightened; an eleventh frame of picture, in which the LEDs of rows 6 to 15 in column 3, the LEDs of rows 4 to 15 in columns 4, 5, and the LEDs of rows 5 to 14 in column 6 in the light-emitting surface are lightened; a twelfth frame of picture, in which the LEDs of rows 8 to 14 in column 3, the LEDs of rows 2 to 15 in columns 4, 5, and the LEDs of rows 4 to 14 in column 6 in the light-emitting surface are lightened; a thirteenth frame of picture, in which the LEDs of rows 4 to 15 in column 3, the LEDs of rows 2 to 16 in columns 4, 5, and the LEDs of rows 6 to 13 in column 6 in the light-emitting surface are lightened; a fourteenth frame of picture, in which the LEDs of rows 5 to 8 in column 1, the LEDs of rows 4 to 12 in column 2, the LEDs of rows 4 to 15 in column 3, the LEDs of rows 1 to 15 in columns 4, 5, and the LEDs of rows 2 to 10 in column 6 in the light-emitting surface are lightened; a fifteenth frame of picture, in which the LEDs of rows 3 to 11 in column 2, the LEDs of rows 1 to 15 in column 3, the LEDs of rows 2 to 16 in column 4, and the LEDs of rows 6 to 15 in column 5 in the light-emitting surface are lightened; a sixteenth frame of picture, in which the LEDs of rows 2 to 7 in column 1, the LEDs of rows 3 to 13 in column 2, the LEDs of rows 4 to 15 in column 3, the LEDs of rows 6 to 15 in column 4, and the LEDs of rows 10 to 14 in column 5 in the light-emitting surface are lightened; a seventeenth frame of picture, in which the LEDs of rows 3 to 11 in column 2, the LEDs of rows 1 to 15 in column 3, the LEDs of rows 2 to 16 in column 4, and the LEDs of rows 6 to 15 in column 5 in the light-emitting surface are lightened; an eighteenth frame of picture, in which the LEDs of rows 7 to 15 in column 3, the LEDs of rows 4 to 16 in column 4, the LEDs of rows 3 to 16 in column 5, the LEDs of rows 3 to 13 in column 6, and the LEDs of rows 4 to 10 in column 7 in the light-emitting surface are lightened; a nineteenth frame of picture, in which the LEDs of rows 5 to 14 in column 3, the LEDs of rows 1 to 15 in columns 4, 5, and the LEDs of rows 5 to 13 in column 6 in the light-emitting surface are lightened; a twentieth frame of picture, in which the LEDs of rows 6 to 14 in column 3, the LEDs of rows 5 to 15 in column 4, the LEDs of rows 4 to 15 in column 5, and the LEDs of rows 5 to 14 in column 6 in the light-emitting surface are lightened; a twenty-first frame of picture, in which the LEDs of rows 6 to 16 in column 4, the LEDs of rows 4 to 16 in column 5, and the LEDs of rows 4 to 15 in column 6 in the light-emitting surface are lightened; a twenty-second frame of picture, in which the LEDs of rows 11 to 16 in column 4, the LEDs of rows 8 to 16 in column 5, the LEDs of rows 6 to 15 in column 6, the LEDs of rows 5 to 14 in column 7, and the LEDs of rows 4 to 12 in column 8 in the light-emitting surface are lightened; a twenty-third frame of picture, in which the LEDs of rows 10 to 16 in column 4, the LEDs of rows 9 to 16 in column 5, the LEDs of rows 8 to 15 in column 6, the LEDs of rows 8 to 13 in column 7, and the LEDs of rows 9 to 12 in column 8 in the light-emitting surface are lightened; a twenty-fourth frame of picture, in which the LEDs of rows 6 to 10 in column 1, the LEDs of rows 6 to 13 in column 2, the LEDs of rows 7 to 16 in columns 3, 4, the LEDs of rows 9 to 16 in column 5, and the LEDs of rows 10 to 16 in column 6 in the light-emitting surface are lightened; and a twenty-fifth frame of picture, in which the LEDs of rows 5 to 15 in column 3, the LEDs of rows 4 to 16 in column 4, the LEDs of rows 5 to 16 in column 5, and the LEDs of rows 6 to 14 in column 6 in the light-emitting surface are lightened.

Preferably, each light-emitting surface circularly displays the first frame of picture to the twenty-fifth frame of picture in sequence so that the electronic candle lamp dynamically displays the candlelight effect with flickering flames.

Preferably, each of the first frame of picture to the twenty-fifth frame of picture is displayed for 100~150 ms.

Preferably, the controlling device comprises a controller and a plurality of controlling circuits, the controller is electrically connected to the plurality of controlling circuits to input instructions to each of the controlling circuits, and each of the controlling circuits is electrically connected to the first LED matrix and the second LED matrix on a corresponding group of the lamp bodies, or connected to the first LED matrix and the second LED matrix on a same light-emitting surface to control the LEDs on each group of the lamp bodies or on each of the light-emitting surfaces so that the electronic candle lamp displays the candlelight effect with flickering flames.

To solve the aforesaid technical problem, another technical solution adopted by the present disclosure is to provide a light-emitting diode (LED) lamp, which comprises a baseplate, a plurality of groups of lamp bodies, a lamp shade and a controlling device. The plurality of groups of lamp bodies are disposed on the baseplate, each group of the lamp bodies respectively comprises a plurality of LEDs arranged in a matrix, the plurality of groups of lamp bodies are arranged about a same center, and every two adjacent lamp bodies form a predetermined angle therebetween; the lamp shade is disposed on the baseplate and has the plurality of groups of lamp bodies nested therein; and the controlling device is electrically connected to the plurality of groups of lamp bodies to control part of the LEDs in each group of the lamp bodies to emit light so that the LED lamp presents light-emitting effects of various forms.

Preferably, each group of the lamp bodies respectively comprises a circuit board, a first LED matrix and a second LED matrix. The circuit board is disposed vertically on the baseplate; the first LED matrix is disposed on a first surface of the circuit board; and the second LED matrix is disposed on a second surface of the circuit board, and the first surface is opposite to the second surface. A first surface of each group of the lamp bodies faces a second surface of an adjacent group of the lamp bodies, and the first LED matrix on the first surface of each group of the lamp bodies and the second LED matrix on the second surface of the adjacent group of the lamp bodies form a light-emitting surface.

Preferably, the LEDs in both the first LED matrix and the second LED matrix of each group of the lamp bodies are LED chips, and the LED chips in the first LED matrix and/or the second LED matrix are integrally encapsulated on the first surface and/or the second surface.

Preferably, the LED lamp presents a candlelight effect with flickering flames.

Preferably, each of the first LED matrix and the second LED matrix on the same light-emitting surface is a 4×16 LED matrix, and the first LED matrix and the second LED matrix together form an 8×16 LED matrix. During the displaying of the LED lamp, an image displayed by each of the light-emitting surfaces at least comprises some or all of the following pictures: a first frame of picture, in which the LEDs of rows 6 to 14 in column 3, the LEDs of rows 3 to 15 in columns 4, 5, and the LEDs of rows 5 to 13 in column 6 in the light-emitting surface are lightened; a second frame of picture, in which the LEDs of rows 7 to 13 in column 3, the LEDs of rows 1 to 15 in columns 4, 5, and the LEDs of rows 5 to 14 in column 6 in the light-emitting surface are lightened; a third frame of picture, in which the LEDs of rows 6 to 12 in column 3, the LEDs of rows 5 to 15 in column 4, the LEDs of rows 3 to 15 in column 5, the LEDs of rows 3 to 13 in column 6, and the LEDs of rows 6 to 11 in column 7 in the light-emitting surface are lightened; a fourth frame of picture, in which the LEDs of rows 6 to 16 in column 4, the LEDs of rows 4 to 16 in column 5, the LEDs of rows 4 to 14 in column 6, and the LEDs of rows 5 to 12 in column 7 in the light-emitting surface are lightened; a fifth frame of picture, in which the LEDs of rows 5 to 15 in column 3, the LEDs of rows 5 to 16 in column 4, the LEDs of rows 6 to 16 in column 5, and the LEDs of rows 9 to 14 in column 6 in the light-emitting surface are lightened; a sixth frame of picture, in which the LEDs of rows 13 to 16 in column 3, the LEDs of rows 12 to 16 in column 4, the LEDs of rows 11 to 16 in columns 5, 6, and the LEDs of rows 12 to 15 in column 7 in the light-emitting surface are lightened; a seventh frame of picture, in which the LEDs of rows 8 to 16 in columns 4, 5, the LEDs of rows 7 to 15 in column 6, the LEDs of rows 7 to 14 in column 7, and the LEDs of rows 7 to 11 in column 8 in the light-emitting surface are lightened; an eighth frame of picture, in which the LEDs of rows 10 to 16 in column 4, the LEDs of rows 8 to 16 in column 5, the LEDs of rows 7 to 16 in column 6, the LEDs of rows 6 to 14 in column 7, and the LEDs of rows 5 to 12 in column 8 in the light-emitting surface are lightened; a ninth frame of picture, in which the LEDs of rows 7 to 16 in column 4, the LEDs of rows 4 to 16 in column 5, the LEDs of rows 3 to 15 in column 6, and the LEDs of rows 3 to 14 in column 7 in the light-emitting surface are lightened; a tenth frame of picture, in which the LEDs of rows 10 to 15 in column 4, the LEDs of rows 7 to 15 in column 5, the LEDs of rows 6 to 14 in column 6, the LEDs of rows 3 to 13 in column 7, and the LEDs of rows 3 to 10 in column 8 in the light-emitting surface are lightened; an eleventh frame of picture, in which the LEDs of rows 6 to 15 in column 3, the LEDs of rows 4 to 15 in columns 4, 5, and the LEDs of rows 5 to 14 in column 6 in the light-emitting surface are lightened; a twelfth frame of picture, in which the LEDs of rows 8 to 14 in column 3, the LEDs of rows 2 to 15 in columns 4, 5, and the LEDs of rows 4 to 14 in column 6 in the light-emitting surface are lightened; a thirteenth frame of picture, in which the LEDs of rows 4 to 15 in column 3, the LEDs of rows 2 to 16 in columns 4, 5, and the LEDs of rows 6 to 13 in column 6 in the light-emitting surface are lightened; a fourteenth frame of picture, in which the LEDs of rows 5 to 8 in column 1, the LEDs of rows 4 to 12 in column 2, the LEDs of rows 4 to 15 in column 3, the LEDs of rows 1 to 15 in columns 4, 5, and the LEDs of rows 2 to 10 in column 6 in the light-emitting surface are lightened; a fifteenth frame of picture, in which the LEDs of rows 3 to 11 in column 2, the LEDs of rows 1 to 15 in column 3, the LEDs of rows 2 to 16 in column 4, and the LEDs of rows 6 to 15 in column 5 in the light-emitting surface are lightened; a sixteenth frame of picture, in which the LEDs of rows 2 to 7 in column 1, the LEDs of rows 3 to 13 in column 2, the LEDs of rows 4 to 15 in column 3, the LEDs of rows 6 to 15 in column 4, and the LEDs of rows 10 to 14 in column 5 in the light-emitting surface are lightened; a seventeenth frame of picture, in which the LEDs of rows 3 to 11 in column 2, the LEDs of rows 1 to 15 in column 3, the LEDs of rows 2 to 16 in column 4, and the LEDs of rows 6 to 15 in column 5 in the light-emitting surface are lightened; an eighteenth frame of picture, in which the LEDs of rows 7 to 15 in column 3, the LEDs of rows 4 to 16 in column 4, the LEDs of rows 3 to 16 in column 5, the LEDs of rows 3 to 13 in column 6, and the LEDs of rows 4 to 10 in column 7 in the light-emitting surface are lightened; a nineteenth frame of picture, in which the LEDs of rows 5 to 14 in column 3, the LEDs of rows 1 to 15 in columns 4, 5, and the LEDs of rows 5 to 13 in column 6 in the light-emitting surface are lightened; a twentieth frame of picture, in which the LEDs of rows 6 to 14 in column 3, the LEDs of rows 5 to 15 in column 4, the LEDs of rows 4 to 15 in column 5, and the LEDs of rows 5 to 14 in column 6 in the light-emitting surface are lightened; a twenty-first frame of picture, in which the LEDs of rows 6 to 16 in column 4, the LEDs of rows 4 to 16 in column 5, and the LEDs of rows 4 to 15 in column 6 in the light-emitting surface are lightened; a twenty-second frame of picture, in which the LEDs of rows 11 to 16 in column 4, the LEDs of rows 8 to 16 in column 5, the LEDs of rows 6 to 15 in column 6, the LEDs of rows 5 to 14 in column 7, and the LEDs of rows 4 to 12 in column 8 in the light-emitting surface are lightened; a twenty-third frame of picture, in which the LEDs of rows 10 to 16 in column 4, the LEDs of rows 9 to 16 in column 5, the LEDs of rows 8 to 15 in column 6, the LEDs of rows 8 to 13 in column 7, and the LEDs of rows 9 to 12 in column 8 in the light-emitting surface are lightened; a twenty-fourth frame of picture, in which the LEDs of rows 6 to 10 in column 1, the LEDs of rows 6 to 13 in column 2, the LEDs of rows 7 to 16 in columns 3, 4, the LEDs of rows 9 to 16 in column 5, and the LEDs of rows 10 to 16 in column 6 in the light-emitting surface are lightened; and a twenty-fifth frame of picture, in which the LEDs of rows 5 to 15 in column 3, the LEDs of rows 4 to 16 in column 4, the LEDs of rows 5 to 16 in column 5, and the LEDs of rows 6 to 14 in column 6 in the light-emitting surface are lightened.

As compared to the prior art, the present disclosure has the following benefits: the LED lamp and the electronic candle lamp of the present disclosure electronically control the LEDs in the plurality of groups of lamp bodies to present the candlelight effect with flickering flames, so a realistic simulation effect is provided; and furthermore, the present disclosure adopts LEDs to replace the traditional candles to emit light, so the lamps of the present disclosure are environment friendly and durable and have a great market.

DETAILED DESCRIPTION OF THE INVENTION

Hereinafter, the present disclosure will be described in detail with reference to the attached drawings and embodiments thereof.

Figure 1:
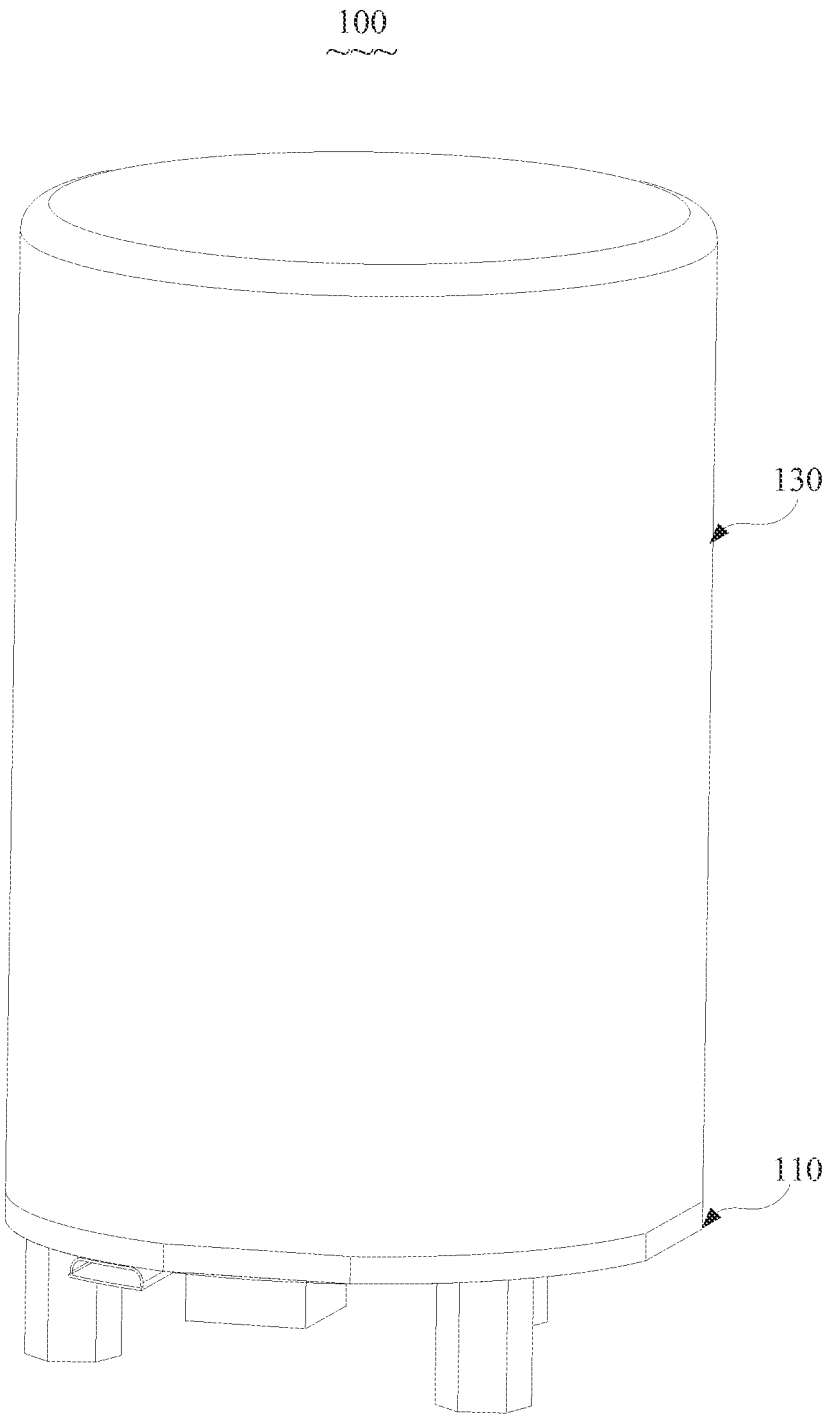
FIG. 1 is a schematic perspective view of a light-emitting diode (LED) lamp according to an embodiment of the present disclosure.
Figure 2:
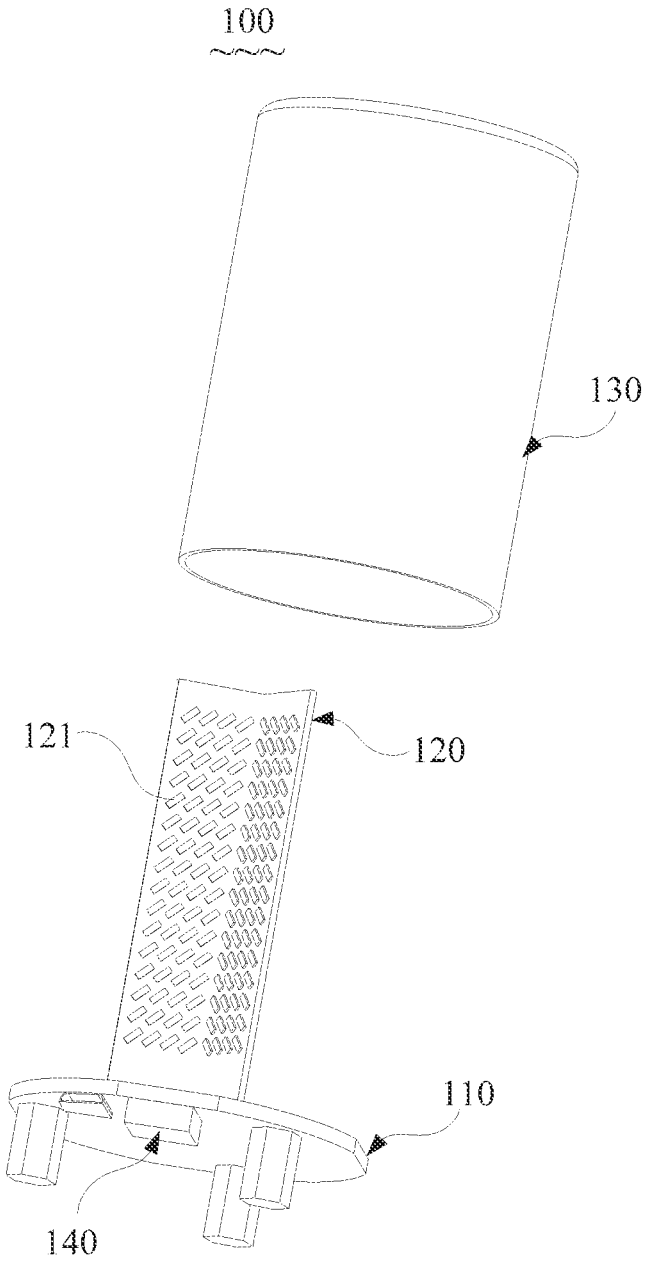
FIG. 2 is a schematic exploded view of the LED shown in FIG. 1.
Figure 3:
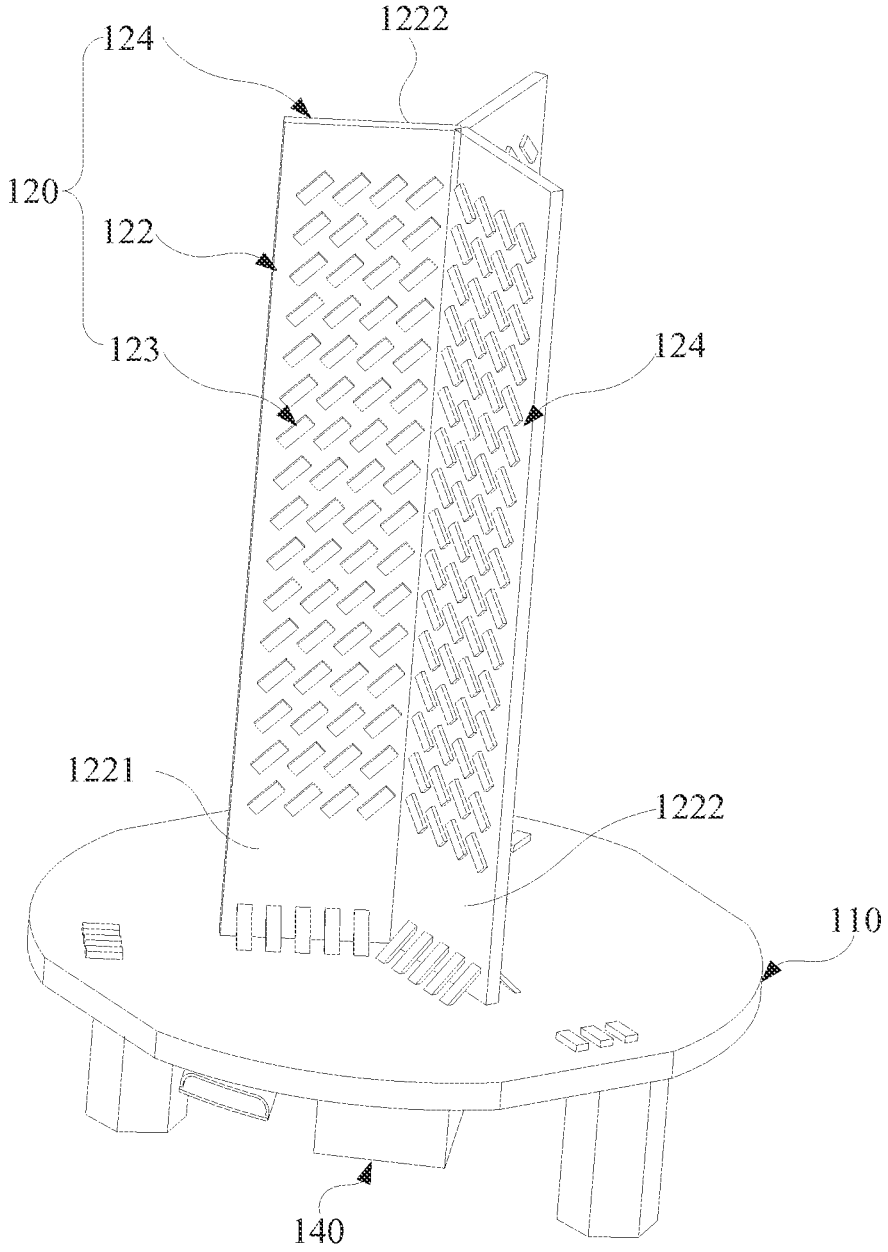
FIG. 3 is a partially enlarged schematic view of the LED shown in FIG. 2.

Referring to FIG. 1 to FIG. 3 together, FIG. 1 is a schematic perspective view of a light-emitting diode (LED) lamp according to an embodiment of the present disclosure; FIG. 2 is a schematic exploded view of the LED shown in FIG. 1; and FIG. 3 is a partially enlarged schematic view of the LED shown in FIG. 2. As shown in FIG. 1 to FIG. 3, an LED lamp 100 of the present disclosure comprises a baseplate 110, a plurality of groups of lamp bodies 120, a lamp shade 130 and a controlling device 140.

The plurality of groups of lamp bodies 120 is disposed on the baseplate 110, each group of the lamp bodies 120 respectively comprises a plurality of light-emitting diodes (LEDs) 121 arranged in a matrix form, the plurality of groups of lamp bodies 120 are arranged about a same center, and every two adjacent lamp bodies 120 form a predetermined angle therebetween.

The lamp shade 130 is disposed on the baseplate 110 and has the plurality of groups of lamp bodies 120 nested therein, and the lamp shade 130 may be made of a transparent material.

The controlling device 140 is electrically connected to the plurality of groups of lamp bodies 120 to control part of the LEDs 121 in each group of the lamp bodies 120 to emit light so that the whole LED lamp 100 can present light-emitting effects of various forms.

In embodiments of the present disclosure, the LED lamp 100 can present the candlelight effect with flickering flames; that is, the LED lamp 100 of the present disclosure is used as an electronic candle lamp. Preferably, the baseplate 110 is disc-shaped, and the lamp shade 130 is cylinder-shaped. Of course, as will be appreciated by those skilled in the art, the baseplate 110 and the lamp shade 130 may also be of other different shapes depending on practical needs.

Each group of the lamp bodies 120 comprises a circuit board 122, a first LED matrix 123 and a second LED matrix 124. The circuit board 122 is disposed on the baseplate 110, the first LED matrix 123 is disposed on a first surface 1221 of the circuit board 122, the second LED matrix 124 is disposed on a second surface 1222 of the circuit board 122, and the first surface 1221 is opposite to the second surface 1222.

Preferably, three groups of lamp bodies 120 are taken as an example to introduce the present disclosure in this embodiment, with every two adjacent lamp bodies 120 forming an angle of 120 degrees therebetween. Of course, as will be appreciated by those skilled in the art, the LED lamp and the electronic candle lamp of the present disclosure may also comprise more groups of lamp bodies, with every two adjacent lamp bodies forming a predetermined angle therebetween. Preferably, the larger the volume of the LED lamp or the electronic candle lamp is, the more the lamp bodies used in the LED lamp or the electronic candle lamp will be.

Moreover, as shown in FIG. 2 and FIG. 3, the first surface 1221 of each group of the lamp bodies 120 faces the second surface 1222 of an adjacent group of the lamp bodies 120, and the first LED matrix 123 on the first surface 1221 of each group of the lamp bodies 120 and the second LED matrix 124 on the second surface 1222 of the adjacent group of the lamp bodies 120 form a light-emitting surface. In this embodiment, three different light-emitting surfaces are formed by the three groups of lamp bodies 120, and each of the light-emitting surfaces is sector-shaped with an angle of 120 degrees.

Figure 4:
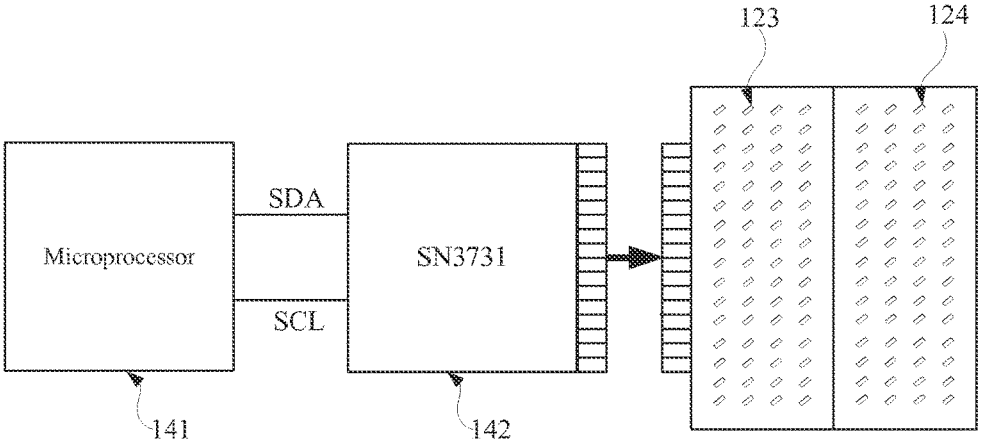
FIG. 4 is a schematic circuit diagram of the LED lamp shown in FIG. 1.

Referring to FIG. 4 together, FIG. 4 is a schematic circuit diagram of the LED lamp 100 shown in FIG. 1. As shown in FIG. 4, the controlling device 140 of the present disclosure comprises a controller 141 and a plurality of controlling circuits 142. The controller 141 is electrically connected to the plurality of controlling circuits 142 respectively to input instructions to each of the controlling circuits 142, and each of the controlling circuits 142 is electrically connected to the first LED matrix 123 and the second LED matrix 124 on a corresponding group of the lamp bodies 120, or connected to the first LED matrix 123 and the second LED matrix 124 on a same light-emitting surface to control the LEDs on each group of the lamp bodies 120 or on each of the light-emitting surfaces.

Preferably, the controller 141 adopts a micro control unit (MCU), and each of the controlling circuits 142 adopts an SN3731 controlling chip with a register disposed therein to store controlling instructions transmitted from the controller 141 and transmit, according to the controlling instructions, corresponding controlling signals to each group of lamp bodies 120 or to the first LED matrix 123 and the second LED matrix 124 on a same light-emitting surface so as to turn on part of the LEDs in the first LED matrix 123 and the second LED matrix 124. Thus, the LED lamp 100 can present the candlelight effect with flickering flames. Of course, as will be appreciated by those skilled in the art, the controller 141 and the controlling circuits 142 may also adopt other types of controlling chips.

Figure 5:
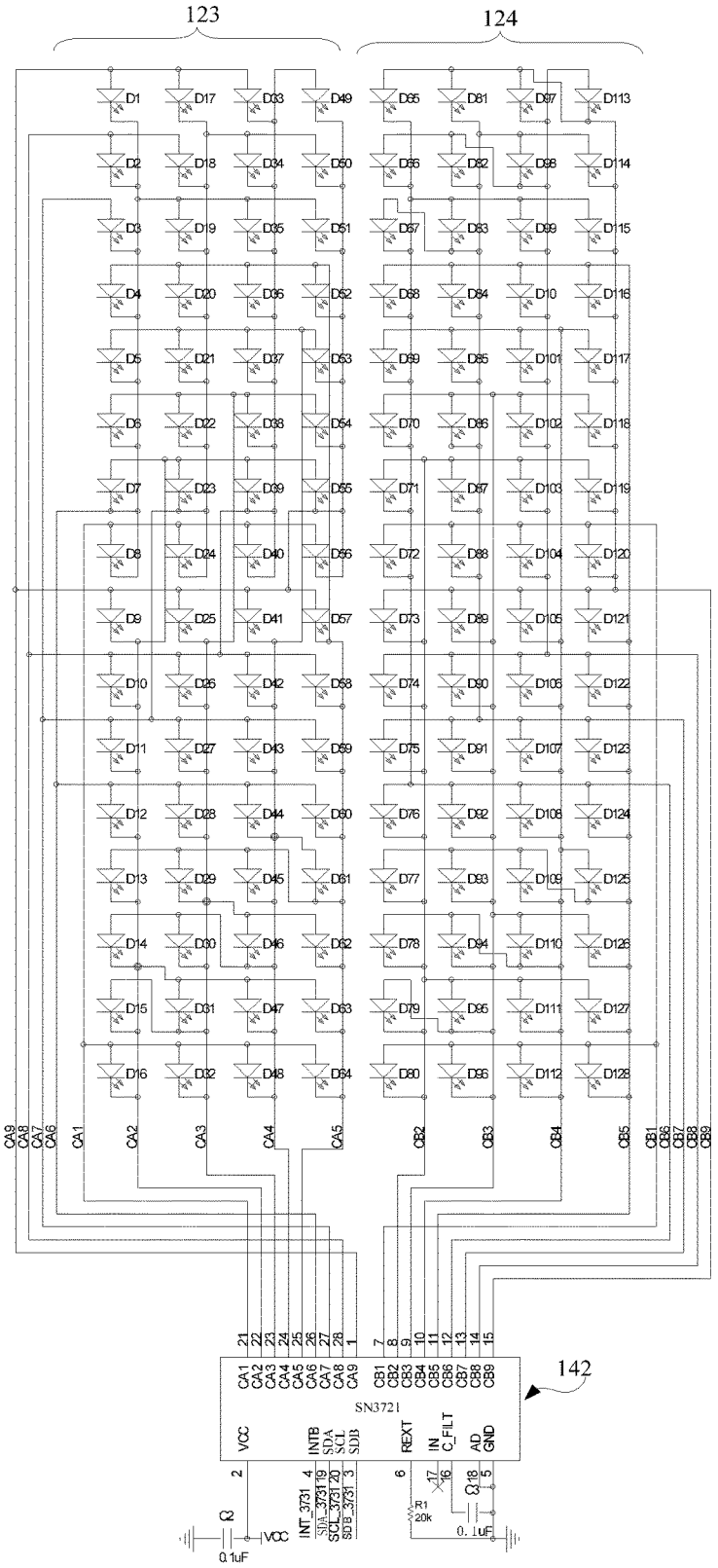
FIG. 5 is a schematic view illustrating the connection between a controlling circuit and a first LED matrix as well as a second LED matrix.

Referring to FIG. 5 together, FIG. 5 is a schematic view illustrating the connection between a controlling circuit and a first LED matrix as well as a second LED matrix. In this embodiment, the first LED matrix 123 and the second LED matrix 124 on a same light-emitting surface are taken as an example to introduce the present disclosure, and the controlling chip 142 adopts an SN3731 controlling chip.

The SN3731 controlling chip can control 144 LEDs (i.e., a 9×16 LED matrix) at most. Thus, in this embodiment, each of the first LED matrix 123 and the second LED matrix 124 is preferably a 4×16 LED matrix, so the first LED matrix 123 and the second LED matrix 124 form an 8×16 LED matrix on a same light-emitting surface. Of course, as will be appreciated by those skilled in the art, the first LED matrix 123 and the second LED matrix 124 may also be other kinds of LED matrixes, e.g., one is a 5×16 LED matrix, and the other is a 4×16 LED matrix, and so on.

Preferably, the connection between the SN3731 controlling chip 142 and the first LED matrix 123 as well as the second LED matrix 124 is as shown in FIG. 3. Of course, as will be appreciated by those skilled in the art, no specific limitation is made to the connection between the SN3731 controlling chip 142 and the first LED matrix 123 as well as the second LED matrix 124 in the present disclosure as long as any LED in the first LED matrix 123 and the second LED matrix 124 can be controlled by the SN3731 controlling chip 142 to be turned on or turned off.

In the present disclosure, each of the LEDs in the first LED matrix 123 and the second LED matrix 124 may be an LED that has already been encapsulated. Alternatively, each of the LEDs in the first LED matrix 123 and the second LED matrix 124 is an LED chip that has not been encapsulated, and instead, the LED chips in the first LED matrix 123 are integrally encapsulated on the first surface 1221 of the circuit board 122, and the LED chips in the second LED matrix 124 are integrally encapsulated on the second surface 1222 of the circuit board 122; or, each of the LEDs in the first LED matrix 123 and the second LED matrix 124 is an LED chip that is not encapsulated, and the lamp shade 130 and the baseplate 110 are used as an encapsulating body to integrally encapsulate the LED chips on the plurality of groups of lamp bodies 120 therein.

Figure 6A:
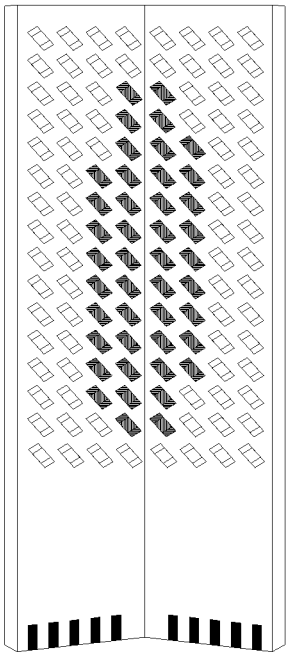
FIG. 6A shows a first frame of picture displayed by the LED lamp of FIG. 1.
Figure 6B:
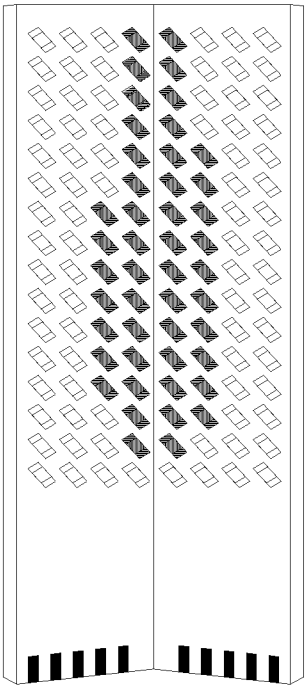
FIG. 6B shows a second frame of picture displayed by the LED lamp of FIG. 1.
Figure 6C:
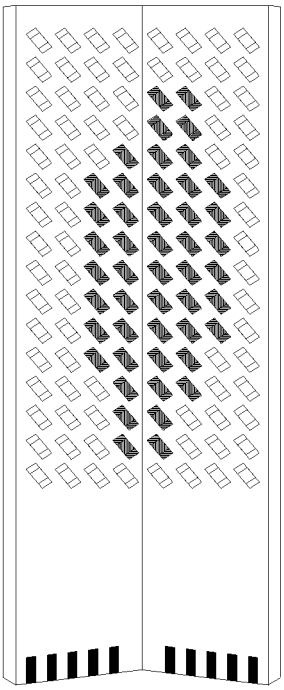
FIG. 6C shows a third frame of picture displayed by the LED lamp of FIG. 1.
Figure 6D:
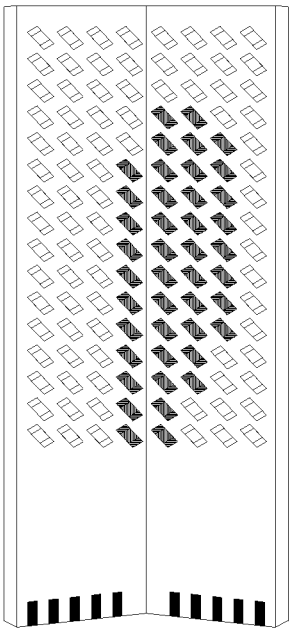
FIG. 6D shows a fourth frame of picture displayed by the LED lamp of FIG. 1.
Figure 6E:
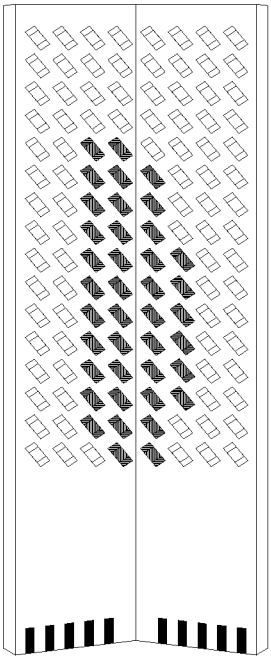
FIG. 6E shows a fifth frame of picture displayed by the LED lamp of FIG. 1.
Figure 6F:
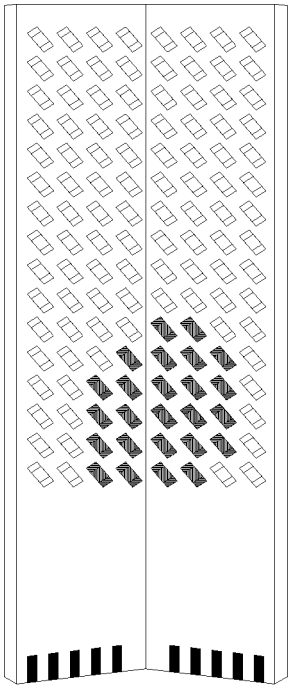
FIG. 6F shows a sixth frame of picture displayed by the LED lamp of FIG. 1.
Figure 6G:
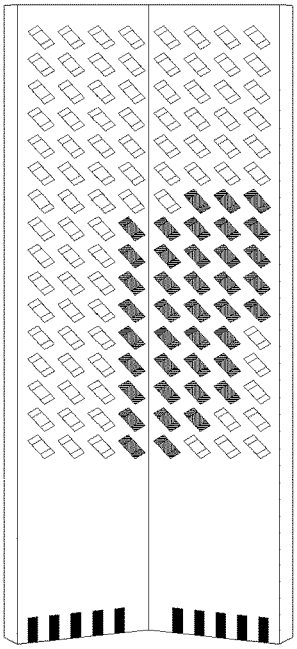
FIG. 6G shows a seventh frame of picture displayed by the LED lamp of FIG. 1.
Figure 6H:
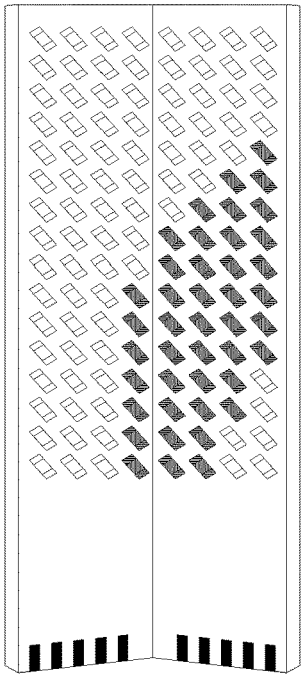
FIG. 6H shows an eighth frame of picture displayed by the LED lamp of FIG. 1.
Figure 6I:
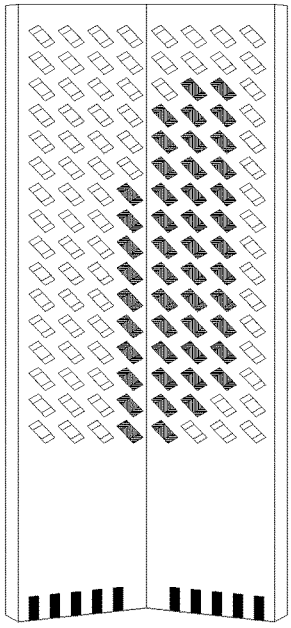
FIG. 6I shows a ninth frame of picture displayed by the LED lamp of FIG. 1.
Figure 6J:
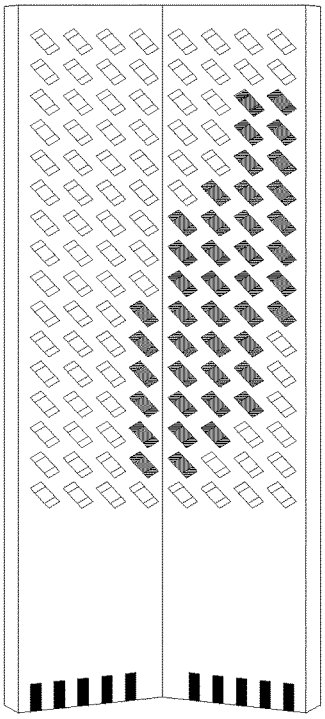
FIG. 6J shows a tenth frame of picture displayed by the LED lamp of FIG. 1.
Figure 6K:
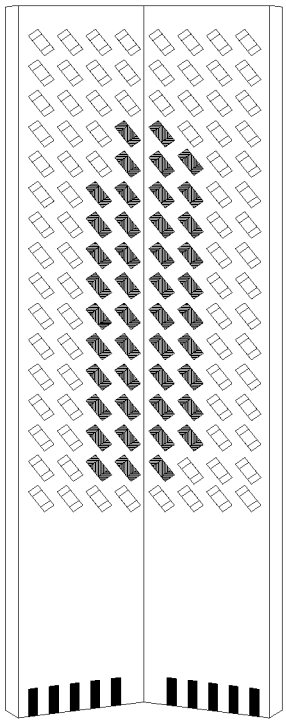
FIG. 6K shows an eleventh frame of picture displayed by the LED lamp of FIG. 1.
Figure 6L:
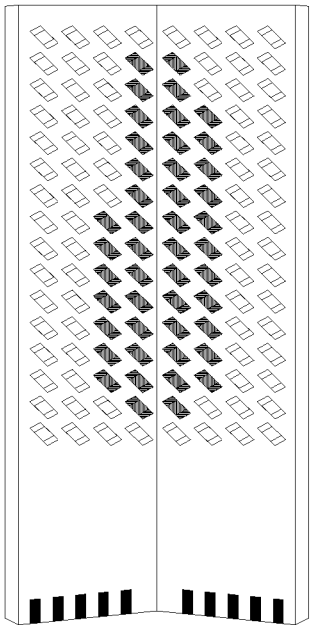
FIG. 6L shows a twelfth frame of picture displayed by the LED lamp of FIG. 1.
Figure 6M:
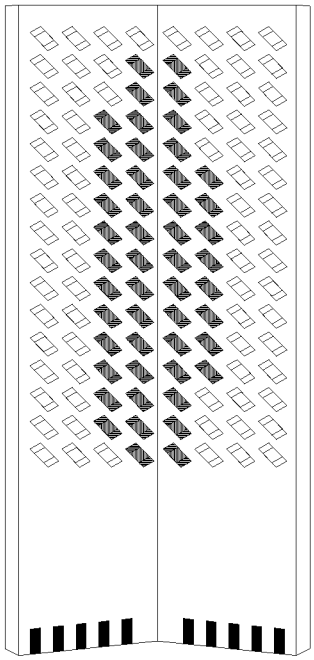
FIG. 6M shows a thirteenth frame of picture displayed by the LED lamp of FIG. 1.
Figure 6N:
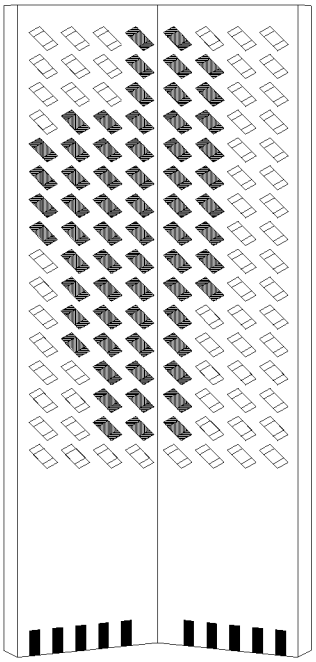
FIG. 6N shows a fourteenth frame of picture displayed by the LED lamp of FIG. 1.
Figure 6O:
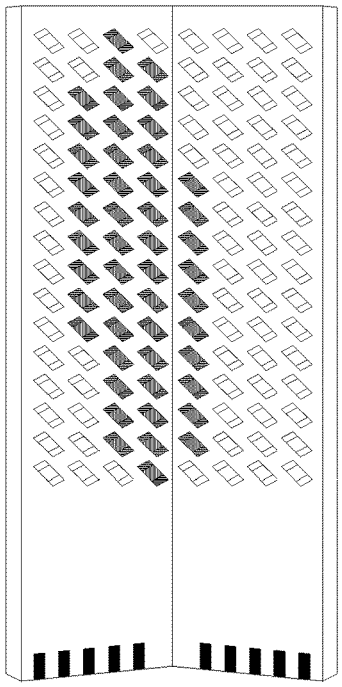
FIG. 6O shows a fifteenth frame of picture displayed by the LED lamp of FIG. 1.
Figure 6P:
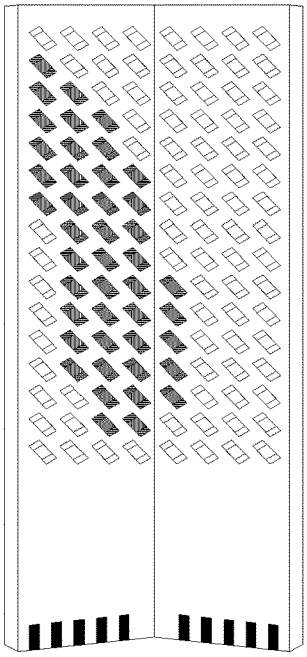
FIG. 6P shows a sixteenth frame of picture displayed by the LED lamp of FIG. 1.
Figure 6Q:
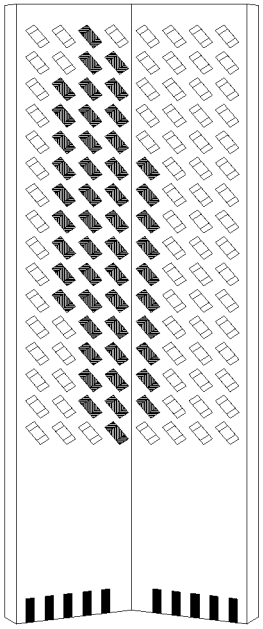
FIG. 6Q shows a seventeenth frame of picture displayed by the LED lamp of FIG. 1.
Figure 6R:
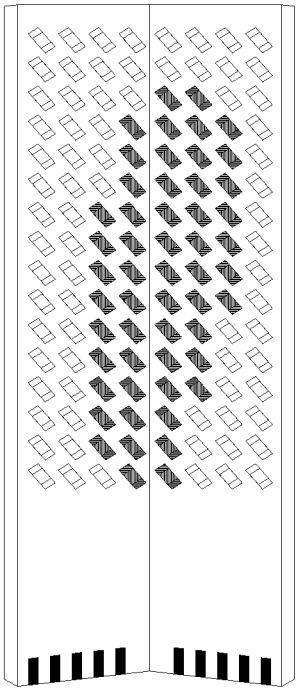
FIG. 6R shows an eighteenth frame of picture displayed by the LED lamp of FIG. 1.
Figure 6S:
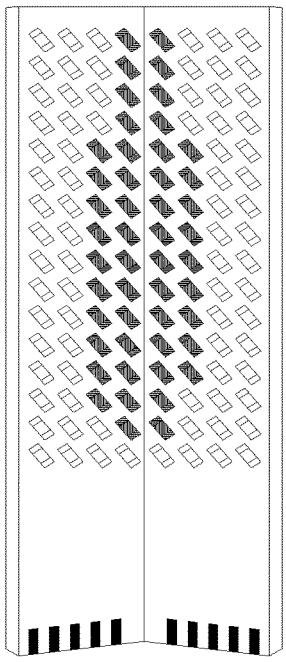
FIG. 6S shows a nineteenth frame of picture displayed by the LED lamp of FIG. 1.
Figure 6T:
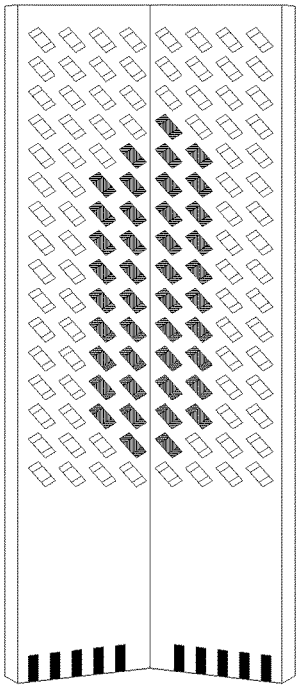
FIG. 6T shows a twentieth frame of picture displayed by the LED lamp of FIG. 1.
Figure 6U:
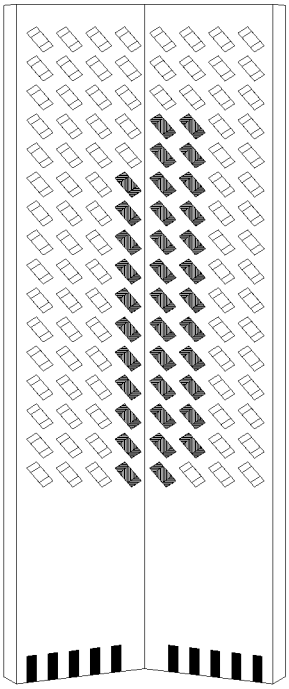
FIG. 6U shows a twenty-first frame of picture displayed by the LED lamp of FIG. 1.
Figure 6V:
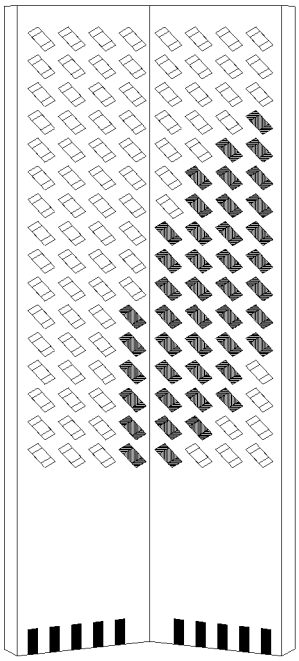
FIG. 6V shows a twenty-second frame of picture displayed by the LED lamp of FIG. 1.
Figure 6W:
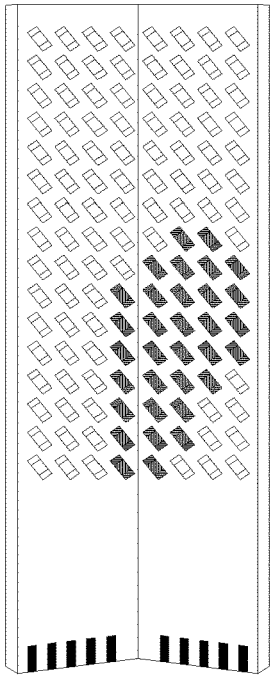
FIG. 6W shows a twenty-third frame of picture displayed by the LED lamp of FIG. 1.
Figure 6X:
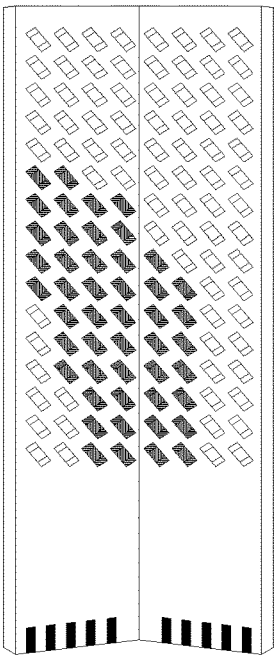
FIG. 6X shows a twenty-fourth frame of picture displayed by the LED lamp of FIG. 1.
Figure 6Y:
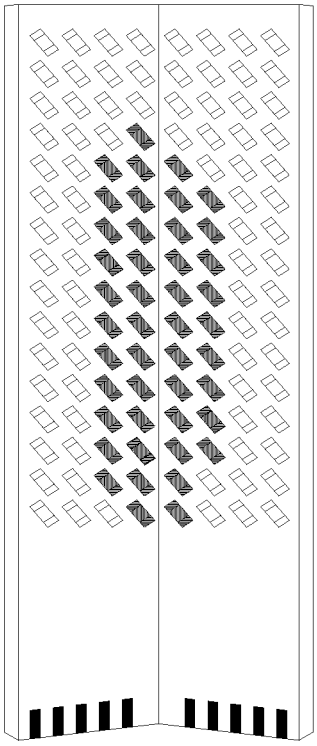
FIG. 6Y shows a twenty-fifth frame of picture displayed by the LED lamp of FIG. 1.

Moreover, further referring to FIGS. 6A to 6Y, FIGS. 6A to 6Y show pictures displayed by the LED lamp 100 of FIG. 1. During the displaying of the LED lamp 100 when being used as an electronic candle lamp, an image displayed by each of the light-emitting surfaces at least comprises some or all of the following pictures:

a first frame of picture, as shown in FIG. 6A, in which the LEDs of rows 6 to 14 in column 3, the LEDs of rows 3 to 15 in columns 4, 5, and the LEDs of rows 5 to 13 in column 6 in the LED matrix (i.e., the 8×16 LED matrix formed by the first 4×16 LED matrix and the second 4×16 LED matrix) of the light-emitting surface are lightened;

a second frame of picture, as shown in FIG. 6B, in which the LEDs of rows 7 to 13 in column 3, the LEDs of rows 1 to 15 in columns 4, 5, and the LEDs of rows 5 to 14 in column 6 in the LED matrix of the light-emitting surface are lightened;

a third frame of picture, as shown in FIG. 6C, in which the LEDs of rows 6 to 12 in column 3, the LEDs of rows 5 to 15 in column 4, the LEDs of rows 3 to 15 in column 5, the LEDs of rows 3 to 13 in column 6, and the LEDs of rows 6 to 11 in column 7 in the LED matrix of the light-emitting surface are lightened;

a fourth frame of picture, as shown in FIG. 6D, in which the LEDs of rows 6 to 16 in column 4, the LEDs of rows 4 to 16 in column 5, the LEDs of rows 4 to 14 in column 6, and the LEDs of rows 5 to 12 in column 7 in the LED matrix of the light-emitting surface are lightened;

a fifth frame of picture, as shown in FIG. 6E, in which the LEDs of rows 5 to 15 in column 3, the LEDs of rows 5 to 16 in column 4, the LEDs of rows 6 to 16 in column 5, and the LEDs of rows 9 to 14 in column 6 in the LED matrix of the light-emitting surface are lightened;

a sixth frame of picture, as shown in FIG. 6F, in which the LEDs of rows 13 to 16 in column 3, the LEDs of rows 12 to 16 in column 4, the LEDs of rows 11 to 16 in columns 5, 6, and the LEDs of rows 12 to 15 in column 7 in the LED matrix of the light-emitting surface are lightened;

a seventh frame of picture, as shown in FIG. 6G, in which the LEDs of rows 8 to 16 in columns 4, 5, the LEDs of rows 7 to 15 in column 6, the LEDs of rows 7 to 14 in column 7, and the LEDs of rows 7 to 11 in column 8 in the LED matrix of the light-emitting surface are lightened;

an eighth frame of picture, as shown in FIG. 6H, in which the LEDs of rows 10 to 16 in column 4, the LEDs of rows 8 to 16 in column 5, the LEDs of rows 7 to 16 in column 6, the LEDs of rows 6 to 14 in column 7, and the LEDs of rows 5 to 12 in column 8 in the LED matrix of the light-emitting surface are lightened;

a ninth frame of picture, as shown in FIG. 6I, in which the LEDs of rows 7 to 16 in column 4, the LEDs of rows 4 to 16 in column 5, the LEDs of rows 3 to 15 in column 6, and the LEDs of rows 3 to 14 in column 7 in the LED matrix of the light-emitting surface are lightened;

a tenth frame of picture, as shown in FIG. 6J, in which the LEDs of rows 10 to 15 in column 4, the LEDs of rows 7 to 15 in column 5, the LEDs of rows 6 to 14 in column 6, the LEDs of rows 3 to 13 in column 7, and the LEDs of rows 3 to 10 in column 8 in the LED matrix of the light-emitting surface are lightened;

an eleventh frame of picture, as shown in FIG. 6K, in which the LEDs of rows 6 to 15 in column 3, the LEDs of rows 4 to 15 in columns 4, 5, and the LEDs of rows 5 to 14 in column 6 in the LED matrix of the light-emitting surface are lightened;

a twelfth frame of picture, as shown in FIG. 6L, in which the LEDs of rows 8 to 14 in column 3, the LEDs of rows 2 to 15 in columns 4, 5, and the LEDs of rows 4 to 14 in column 6 in the LED matrix of the light-emitting surface are lightened;

a thirteenth frame of picture, as shown in FIG. 6M, in which the LEDs of rows 4 to 15 in column 3, the LEDs of rows 2 to 16 in columns 4, 5, and the LEDs of rows 6 to 13 in column 6 in the LED matrix of the light-emitting surface are lightened;

a fourteenth frame of picture, as shown in FIG. 6N, in which the LEDs of rows 5 to 8 in column 1, the LEDs of rows 4 to 12 in column 2, the LEDs of rows 4 to 15 in column 3, the LEDs of rows 1 to 15 in columns 4, 5, and the LEDs of rows 2 to 10 in column 6 in the LED matrix of the light-emitting surface are lightened;

a fifteenth frame of picture, as shown in FIG. 6O, in which the LEDs of rows 3 to 11 in column 2, the LEDs of rows 1 to 15 in column 3, the LEDs of rows 2 to 16 in column 4, and the LEDs of rows 6 to 15 in column 5 in the LED matrix of the light-emitting surface are lightened;

a sixteenth frame of picture, as shown in FIG. 6P, in which the LEDs of rows 2 to 7 in column 1, the LEDs of rows 3 to 13 in column 2, the LEDs of rows 4 to 15 in column 3, the LEDs of rows 6 to 15 in column 4, and the LEDs of rows 10 to 14 in column 5 in the LED matrix of the light-emitting surface are lightened;

a seventeenth frame of picture, as shown in FIG. 6Q, in which the LEDs of rows 3 to 11 in column 2, the LEDs of rows 1 to 15 in column 3, the LEDs of rows 2 to 16 in column 4, and the LEDs of rows 6 to 15 in column 5 in the LED matrix of the light-emitting surface are lightened;

an eighteenth frame of picture, as shown in FIG. 6R, in which the LEDs of rows 7 to 15 in column 3, the LEDs of rows 4 to 16 in column 4, the LEDs of rows 3 to 16 in column 5, the LEDs of rows 3 to 13 in column 6, and the LEDs of rows 4 to 10 in column 7 in the LED matrix of the light-emitting surface are lightened;

a nineteenth frame of picture, as shown in FIG. 6S, in which the LEDs of rows 5 to 14 in column 3, the LEDs of rows 1 to 15 in columns 4, 5, and the LEDs of rows 5 to 13 in column 6 in the LED matrix of the light-emitting surface are lightened;

a twentieth frame of picture, as shown in FIG. 6T, in which the LEDs of rows 6 to 14 in column 3, the LEDs of rows 5 to 15 in column 4, the LEDs of rows 4 to 15 in column 5, and the LEDs of rows 5 to 14 in column 6 in the LED matrix of the light-emitting surface are lightened;

a twenty-first frame of picture, as shown in FIG. 6U, in which the LEDs of rows 6 to 16 in column 4, the LEDs of rows 4 to 16 in column 5, and the LEDs of rows 4 to 15 in column 6 in the LED matrix of the light-emitting surface are lightened;

a twenty-second frame of picture, as shown in FIG. 6V, in which the LEDs of rows 11 to 16 in column 4, the LEDs of rows 8 to 16 in column 5, the LEDs of rows 6 to 15 in column 6, the LEDs of rows 5 to 14 in column 7, and the LEDs of rows 4 to 12 in column 8 in the LED matrix of the light-emitting surface are lightened;

a twenty-third frame of picture, as shown in FIG. 6W, in which the LEDs of rows 10 to 16 in column 4, the LEDs of rows 9 to 16 in column 5, the LEDs of rows 8 to 15 in column 6, the LEDs of rows 8 to 13 in column 7, and the LEDs of rows 9 to 12 in column 8 in the LED matrix of the light-emitting surface are lightened;

a twenty-fourth frame of picture, as shown in FIG. 6X, in which the LEDs of rows 6 to 10 in column 1, the LEDs of rows 6 to 13 in column 2, the LEDs of rows 7 to 16 in columns 3, 4, the LEDs of rows 9 to 16 in column 5, and the LEDs of rows 10 to 16 in column 6 in the LED matrix of the light-emitting surface are lightened; and a twenty-fifth frame of picture, as shown in FIG. 6Y, in which the LEDs of rows 5 to 15 in column 3, the LEDs of rows 4 to 16 in column 4, the LEDs of rows 5 to 16 in column 5, and the LEDs of rows 6 to 14 in column 6 in the LED matrix of the light-emitting surface are lightened.

As will be appreciated by those skilled in the art, in order to make the electronic candle lamp display a relatively good candlelight effect with flickering flames, preferably each of the light-emitting surfaces circularly displays the aforesaid twenty-five frames of pictures in sequence so that the electronic candle lamp can dynamically and realistically simulate the candlelight effect with flickering flames emitted from a lightened candle.

Of course, as will be appreciated by those skilled in the art, maybe only part of the aforesaid twenty-five frames of pictures are selected and displayed circularly during the displaying of the electronic candle lamp, and this can also simulate the candlelight effect of a lightened candle except that the displaying effect is not so good; or, other pictures may be added to the aforesaid twenty-five frames of pictures to add other special displaying effects.

Moreover, during the displaying, each of the aforesaid twenty-five frames of pictures is displayed for a predetermined period of time, e.g., 100~150 ms, and preferably for 130 ms. Of course, as will be appreciated by those skilled in the art, the aforesaid predetermined period of time may be adjusted depending on practical needs.

According to the above descriptions, the LED lamp and the electronic candle lamp of the present disclosure electronically control the LEDs in the plurality of groups of lamp bodies to display the candlelight effect with flickering flames, so a realistic simulation effect is provided; and furthermore, the present disclosure adopts LEDs to replace the traditional candles to emit light, so the lamps of the present disclosure are environment friendly and durable and have a great market.

What described above are only the embodiments of the present disclosure, but are not intended to limit the scope of the present disclosure. Any equivalent structures or equivalent process flow modifications that are made according to the specification and the attached drawings of the present disclosure, or any direct or indirect applications of the present disclosure in other related technical fields shall all be covered within the scope of the present disclosure.

What is claimed is:

1. An electronic candle lamp, comprising:

a baseplate;

a plurality of groups of lamp bodies, disposed on the baseplate, wherein all groups of lamp bodies are connected to a same center, and extend out from the same center, every two adjacent lamp bodies form a predetermined angle therebetween, and each group of the lamp bodies respectively comprises:

a circuit board, disposed vertically on the baseplate;

a first LED matrix, disposed on a first surface of the circuit board; and a second LED matrix, disposed on a second surface of the circuit board, wherein the first surface is opposite to the second surface;

wherein the first surface of each group of the lamp bodies faces the second surface of an adjacent group of the lamp bodies, and the first LED matrix on the first surface of each group of the lamp bodies and the second LED matrix on the second surface of the adjacent group of the lamp bodies form a light-emitting surface such that at least one whole light-emitting surface is visible at any viewing location;

a lamp shade, disposed on the baseplate and having the plurality of groups of lamp bodies nested therein; and a controlling device, electrically connected to the plurality of groups of lamp bodies, and being configured to control part of the LEDs in each group of the lamp bodies to emit light so that the electronic candle lamp presents a candlelight effect with flickering flames;

wherein each of the first LED matrix and the second LED matrix on the same light-emitting surface is a 4×16 LED matrix respectively, and the first LED matrix and the second LED matrix together form an 8×16 LED matrix;

wherein during the displaying of the electronic candle lamp, images displayed by each light-emitting surface at least comprises some or all of following pictures:

a first frame of picture, in which the LEDs of rows 6 to 14 in column 3, the LEDs of rows 3 to 15 in columns 4, 5, and the LEDs of rows 5 to 13 in column 6 in the light-emitting surface are lightened;

a second frame of picture, in which the LEDs of rows 7 to 13 in column 3, the LEDs of rows 1 to 15 in columns 4, 5, and the LEDs of rows 5 to 14 in column 6 in the light-emitting surface are lightened;

a third frame of picture, in which the LEDs of rows 6 to 12 in column 3, the LEDs of rows 5 to 15 in column 4, the LEDs of rows 3 to 15 in column 5, the LEDs of rows 3 to 13 in column 6, and the LEDs of rows 6 to 11 in column 7 in the light-emitting surface are lightened;

a fourth frame of picture, in which the LEDs of rows 6 to 16 in column 4, the LEDs of rows 4 to 16 in column 5, the LEDs of rows 4 to 14 in column 6, and the LEDs of rows 5 to 12 in column 7 in the light-emitting surface are lightened;

a fifth frame of picture, in which the LEDs of rows 5 to 15 in column 3, the LEDs of rows 5 to 16 in column 4, the LEDs of rows 6 to 16 in column 5, and the LEDs of rows 9 to 14 in column 6 in the light-emitting surface are lightened;

a sixth frame of picture, in which the LEDs of rows 13 to 16 in column 3, the LEDs of rows 12 to 16 in column 4, the LEDs of rows 11 to 16 in columns 5, 6, and the LEDs of rows 12 to 15 in column 7 in the light-emitting surface are lightened;

a seventh frame of picture, in which the LEDs of rows 8 to 16 in columns 4, 5, the LEDs of rows 7 to 15 in column 6, the LEDs of rows 7 to 14 in column 7, and the LEDs of rows 7 to 11 in column 8 in the light-emitting surface are lightened;

an eighth frame of picture, in which the LEDs of rows 10 to 16 in column 4, the LEDs of rows 8 to 16 in column 5, the LEDs of rows 7 to 16 in column 6, the LEDs of rows 6 to 14 in column 7, and the LEDs of rows 5 to 12 in column 8 in the light-emitting surface are lightened;

a ninth frame of picture, in which the LEDs of rows 7 to 16 in column 4, the LEDs of rows 4 to 16 in column 5, the LEDs of rows 3 to 15 in column 6, and the LEDs of rows 3 to 14 in column 7 in the light-emitting surface are lightened;

a tenth frame of picture, in which the LEDs of rows 10 to 15 in column 4, the LEDs of rows 7 to 15 in column 5, the LEDs of rows 6 to 14 in column 6, the LEDs of rows 3 to 13 in column 7, and the LEDs of rows 3 to 10 in column 8 in the light-emitting surface are lightened;

an eleventh frame of picture, in which the LEDs of rows 6 to 15 in column 3, the LEDs of rows 4 to 15 in columns 4, 5, and the LEDs of rows 5 to 14 in column 6 in the light-emitting surface are lightened;

a twelfth frame of picture, in which the LEDs of rows 8 to 14 in column 3, the LEDs of rows 2 to 15 in columns 4, 5, and the LEDs of rows 4 to 14 in column 6 in the light-emitting surface are lightened;

a thirteenth frame of picture, in which the LEDs of rows 4 to 15 in column 3, the LEDs of rows 2 to 16 in columns 4, 5, and the LEDs of rows 6 to 13 in column 6 in the light-emitting surface are lightened;

a fourteenth frame of picture, in which the LEDs of rows 5 to 8 in column 1, the LEDs of rows 4 to 12 in column 2, the LEDs of rows 4 to 15 in column 3, the LEDs of rows 1 to 15 in columns 4, 5, and the LEDs of rows 2 to 10 in column 6 in the light-emitting surface are lightened;

a fifteenth frame of picture, in which the LEDs of rows 3 to 11 in column 2, the LEDs of rows 1 to 15 in column 3, the LEDs of rows 2 to 16 in column 4, and the LEDs of rows 6 to 15 in column 5 in the light-emitting surface are lightened;

a sixteenth frame of picture, in which the LEDs of rows 2 to 7 in column 1, the LEDs of rows 3 to 13 in column 2, the LEDs of rows 4 to 15 in column 3, the LEDs of rows 6 to 15 in column 4, and the LEDs of rows 10 to 14 in column 5 in the light-emitting surface are lightened;

a seventeenth frame of picture, in which the LEDs of rows 3 to 11 in column 2, the LEDs of rows 1 to 15 in column 3, the LEDs of rows 2 to 16 in column 4, and the LEDs of rows 6 to 15 in column 5 in the light-emitting surface are lightened;

an eighteenth frame of picture, in which the LEDs of rows 7 to 15 in column 3, the LEDs of rows 4 to 16 in column 4, the LEDs of rows 3 to 16 in column 5, the LEDs of rows 3 to 13 in column 6, and the LEDs of rows 4 to 10 in column 7 in the light-emitting surface are lightened;

a nineteenth frame of picture, in which the LEDs of rows 5 to 14 in column 3, the LEDs of rows 1 to 15 in columns 4, 5, and the LEDs of rows 5 to 13 in column 6 in the light-emitting surface are lightened;

a twentieth frame of picture, in which the LEDs of rows 6 to 14 in column 3, the LEDs of rows 5 to 15 in column 4, the LEDs of rows 4 to 15 in column 5, and the LEDs of rows 5 to 14 in column 6 in the light-emitting surface are lightened;

a twenty-first frame of picture, in which the LEDs of rows 6 to 16 in column 4, the LEDs of rows 4 to 16 in column 5, and the LEDs of rows 4 to 15 in column 6 in the light-emitting surface are lightened;

a twenty-second frame of picture, in which the LEDs of rows 11 to 16 in column 4, the LEDs of rows 8 to 16 in column 5, the LEDs of rows 6 to 15 in column 6, the LEDs of rows 5 to 14 in column 7, and the LEDs of rows 4 to 12 in column 8 in the light-emitting surface are lightened;

a twenty-third frame of picture, in which the LEDs of rows 10 to 16 in column 4, the LEDs of rows 9 to 16 in column 5, the LEDs of rows 8 to 15 in column 6, the LEDs of rows 8 to 13 in column 7, and the LEDs of rows 9 to 12 in column 8 in the light-emitting surface are lightened;

a twenty-fourth frame of picture, in which the LEDs of rows 6 to 10 in column 1, the LEDs of rows 6 to 13 in column 2, the LEDs of rows 7 to 16 in columns 3, 4, the LEDs of rows 9 to 16 in column 5, and the LEDs of rows 10 to 16 in column 6 in the light-emitting surface are lightened; and a twenty-fifth frame of picture, in which the LEDs of rows 5 to 15 in column 3, the LEDs of rows 4 to 16 in column 4, the LEDs of rows 5 to 16 in column 5, and the LEDs of rows 6 to 14 in column 6 in the light-emitting surface are lightened;

wherein each light-emitting surface circularly displays the first frame of picture to the twenty-fifth frame of picture in sequence, so that the electronic candle lamp dynamically displays the candlelight effect with flickering flames.

2. The electronic candle lamp of claim 1, comprising three groups of the lamp bodies, and every two adjacent lamp bodies form an angle of 120 degrees therebetween.

3. The electronic candle lamp of claim 1, wherein each of the first frame of picture to the twenty-fifth frame of picture is displayed for 100~150 ms.

4. The electronic candle lamp of claim 1, wherein the controlling device comprises a controller and a plurality of controlling circuits, the controller is electrically connected to the plurality of controlling circuits to input instructions to each of the controlling circuits, and each of the controlling circuits is electrically connected to the first LED matrix and the second LED matrix on a corresponding group of the lamp bodies, or connected to the first LED matrix and the second LED matrix on a same light-emitting surface, to control the LEDs on each group of the lamp bodies or on each light-emitting surface so that the electronic candle lamp displays the candlelight effect with flickering flames.

5. A light-emitting diode (LED) lamp, comprising:

a baseplate;

a plurality of groups of lamp bodies, disposed on the baseplate, wherein all groups of lamp bodies are connected to a same center, and extend out from the same center, and every two adjacent lamp bodies form a predetermined angle therebetween; and each group of the lamp bodies respectively comprises:

a circuit board, disposed vertically on the baseplate;

a first LED matrix, disposed on a first surface of the circuit board; and a second LED matrix, disposed on a second surface of the circuit board, wherein the first surface is opposite to the second surface;

wherein the first surface of each group of the lamp bodies faces the second surface of an adjacent group of the lamp bodies, and the first LED matrix on the first surface of each group of the lamp bodies and the second LED matrix on the second surface of the adjacent group of the lamp bodies form a light-emitting surface such that at least one whole light-emitting surface is visible at any viewing location;

a lamp shade, disposed on the baseplate and having the plurality of groups of lamp bodies nested therein; and a controlling device, electrically connected to the plurality of groups of lamp bodies to control part of the LEDs in each group of the lamp bodies to emit light so that the LED lamp presents light-emitting effects of various forms;

wherein each of the first LED matrix and the second LED matrix on the same light-emitting surface is a 4×16 LED matrix respectively, and the first LED matrix and the second LED matrix together form an 8×16 LED matrix;

wherein during the displaying of the LED lamp, images displayed by each of the light-emitting surfaces at least comprises some or all of following pictures:

a first frame of picture, in which the LEDs of rows 6 to 14 in column 3, the LEDs of rows 3 to 15 in columns 4, 5, and the LEDs of rows 5 to 13 in column 6 in the light-emitting surface are lightened;

a second frame of picture, in which the LEDs of rows 7 to 13 in column 3, the LEDs of rows 1 to 15 in columns 4, 5, and the LEDs of rows 5 to 14 in column 6 in the light-emitting surface are lightened;

a third frame of picture, in which the LEDs of rows 6 to 12 in column 3, the LEDs of rows 5 to 15 in column 4, the LEDs of rows 3 to 15 in column 5, the LEDs of rows 3 to 13 in column 6, and the LEDs of rows 6 to 11 in column 7 in the light-emitting surface are lightened;

a fourth frame of picture, in which the LEDs of rows 6 to 16 in column 4, the LEDs of rows 4 to 16 in column 5, the LEDs of rows 4 to 14 in column 6, and the LEDs of rows 5 to 12 in column 7 in the light-emitting surface are lightened;

a fifth frame of picture, in which the LEDs of rows 5 to 15 in column 3, the LEDs of rows 5 to 16 in column 4, the LEDs of rows 6 to 16 in column 5, and the LEDs of rows 9 to 14 in column 6 in the light-emitting surface are lightened;

a sixth frame of picture, in which the LEDs of rows 13 to 16 in column 3, the LEDs of rows 12 to 16 in column 4, the LEDs of rows 11 to 16 in columns 5, 6, and the LEDs of rows 12 to 15 in column 7 in the light-emitting surface are lightened;

a seventh frame of picture, in which the LEDs of rows 8 to 16 in columns 4, 5, the LEDs of rows 7 to 15 in column 6, the LEDs of rows 7 to 14 in column 7, and the LEDs of rows 7 to 11 in column 8 in the light-emitting surface are lightened;

an eighth frame of picture, in which the LEDs of rows 10 to 16 in column 4, the LEDs of rows 8 to 16 in column 5, the LEDs of rows 7 to 16 in column 6, the LEDs of rows 6 to 14 in column 7, and the LEDs of rows 5 to 12 in column 8 in the light-emitting surface are lightened;

a ninth frame of picture, in which the LEDs of rows 7 to 16 in column 4, the LEDs of rows 4 to 16 in column 5, the LEDs of rows 3 to 15 in column 6, and the LEDs of rows 3 to 14 in column 7 in the light-emitting surface are lightened;

a tenth frame of picture, in which the LEDs of rows 10 to 15 in column 4, the LEDs of rows 7 to 15 in column 5, the LEDs of rows 6 to 14 in column 6, the LEDs of rows 3 to 13 in column 7, and the LEDs of rows 3 to 10 in column 8 in the light-emitting surface are lightened;

an eleventh frame of picture, in which the LEDs of rows 6 to 15 in column 3, the LEDs of rows 4 to 15 in columns 4, 5, and the LEDs of rows 5 to 14 in column 6 in the light-emitting surface are lightened;

a twelfth frame of picture, in which the LEDs of rows 8 to 14 in column 3, the LEDs of rows 2 to 15 in columns 4, 5, and the LEDs of rows 4 to 14 in column 6 in the light-emitting surface are lightened;

a thirteenth frame of picture, in which the LEDs of rows 4 to 15 in column 3, the LEDs of rows 2 to 16 in columns 4, 5, and the LEDs of rows 6 to 13 in column 6 in the light-emitting surface are lightened;

a fourteenth frame of picture, in which the LEDs of rows 5 to 8 in column 1, the LEDs of rows 4 to 12 in column 2, the LEDs of rows 4 to 15 in column 3, the LEDs of rows 1 to 15 in columns 4, 5, and the LEDs of rows 2 to 10 in column 6 in the light-emitting surface are lightened;

a fifteenth frame of picture, in which the LEDs of rows 3 to 11 in column 2, the LEDs of rows 1 to 15 in column 3, the LEDs of rows 2 to 16 in column 4, and the LEDs of rows 6 to 15 in column 5 in the light-emitting surface are lightened;

a sixteenth frame of picture, in which the LEDs of rows 2 to 7 in column 1, the LEDs of rows 3 to 13 in column 2, the LEDs of rows 4 to 15 in column 3, the LEDs of rows 6 to 15 in column 4, and the LEDs of rows 10 to 14 in column 5 in the light-emitting surface are lightened;

a seventeenth frame of picture, in which the LEDs of rows 3 to 11 in column 2, the LEDs of rows 1 to 15 in column 3, the LEDs of rows 2 to 16 in column 4, and the LEDs of rows 6 to 15 in column 5 in the light-emitting surface are lightened;

an eighteenth frame of picture, in which the LEDs of rows 7 to 15 in column 3, the LEDs of rows 4 to 16 in column 4, the LEDs of rows 3 to 16 in column 5, the LEDs of rows 3 to 13 in column 6, and the LEDs of rows 4 to 10 in column 7 in the light-emitting surface are lightened;

a nineteenth frame of picture, in which the LEDs of rows 5 to 14 in column 3, the LEDs of rows 1 to 15 in columns 4, 5, and the LEDs of rows 5 to 13 in column 6 in the light-emitting surface are lightened;

a twentieth frame of picture, in which the LEDs of rows 6 to 14 in column 3, the LEDs of rows 5 to 15 in column 4, the LEDs of rows 4 to 15 in column 5, and the LEDs of rows 5 to 14 in column 6 in the light-emitting surface are lightened;

a twenty-first frame of picture, in which the LEDs of rows 6 to 16 in column 4, the LEDs of rows 4 to 16 in column 5, and the LEDs of rows 4 to 15 in column 6 in the light-emitting surface are lightened;

a twenty-second frame of picture, in which the LEDs of rows 11 to 16 in column 4, the LEDs of rows 8 to 16 in column 5, the LEDs of rows 6 to 15 in column 6, the LEDs of rows 5 to 14 in column 7, and the LEDs of rows 4 to 12 in column 8 in the light-emitting surface are lightened;

a twenty-third frame of picture, in which the LEDs of rows 10 to 16 in column 4, the LEDs of rows 9 to 16 in column 5, the LEDs of rows 8 to 15 in column 6, the LEDs of rows 8 to 13 in column 7, and the LEDs of rows 9 to 12 in column 8 in the light-emitting surface are lightened;

a twenty-fourth frame of picture, in which the LEDs of rows 6 to 10 in column 1, the LEDs of rows 6 to 13 in column 2, the LEDs of rows 7 to 16 in columns 3, 4, the LEDs of rows 9 to 16 in column 5, and the LEDs of rows 10 to 16 in column 6 in the light-emitting surface are lightened; and a twenty-fifth frame of picture, in which the LEDs of rows 5 to 15 in column 3, the LEDs of rows 4 to 16 in column 4, the LEDs of rows 5 to 16 in column 5, and the LEDs of rows 6 to 14 in column 6 in the light-emitting surface are lightened;

wherein each light-emitting surface circularly displays the first frame of picture to the twenty-fifth frame of picture in sequence, so that the LED lamp dynamically displays the candlelight effect with flickering flames.

6. The LED lamp of claim 5, wherein the LEDs in both the first LED matrix and the second LED matrix of each group of the lamp bodies are LED chips, and the LED chips in the first LED matrix and/or the second LED matrix are integrally encapsulated on the first surface and/or the second surface.

* * * * *